US007095013B2

(12) United States Patent
Bateman et al.

(10) Patent No.: US 7,095,013 B2
(45) Date of Patent: Aug. 22, 2006

(54) MASS SPECTROMETER

(75) Inventors: Robert Harold Bateman, Knutsford (GB); Kevin Giles, Altrincham (GB); Steve Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 513 days.

(21) Appl. No.: 10/448,057

(22) Filed: May 30, 2003

(65) Prior Publication Data

US 2004/0026611 A1 Feb. 12, 2004

Related U.S. Application Data

(60) Provisional application No. 60/421,764, filed on Oct. 29, 2002.

(30) Foreign Application Priority Data

May 30, 2002 (GB) ..... 0212508
Apr. 11, 2003 (GB) ..... 0308411

(51) Int. Cl.
*H01J 49/40* (2006.01)

(52) U.S. Cl. ..... 250/281; 250/287; 250/286; 250/282; 250/290; 250/292

(58) Field of Classification Search ..... 250/287, 250/281, 286, 282, 290, 292
See application file for complete search history.

(56) References Cited

U.S. PATENT DOCUMENTS 5,206,506 A 4/1993 Kirchner
5,572,035 A 11/1996 Franzen
5,811,800 A 9/1998 Franzen et al.
5,818,055 A 10/1998 Franzen
5,847,386 A 12/1998 Thomson et al.
5,905,258 A 5/1999 Clemmer et al.
6,020,586 A * 2/2000 Dresch et al. ..... 250/287
6,107,628 A 8/2000 Smith et al.
6,403,953 B1 6/2002 Whitehouse et al.
6,417,511 B1 7/2002 Russ, IV et al.
6,489,610 B1 12/2002 Barofsky et al.
6,545,268 B1 4/2003 Verentchikov et al.
6,559,444 B1 5/2003 Franzen
6,693,276 B1 2/2004 Weiss et al.
2001/0032939 A1 10/2001 Fuhrer et al.
2002/0063207 A1 5/2002 Bateman et al.
2002/0063209 A1 5/2002 Bateman et al.
2002/0063210 A1 5/2002 Bateman et al.
2002/0070338 A1 * 6/2002 Loboda ..... 250/287
2002/0079443 A1 6/2002 Krutchinsky et al.
2002/0113207 A1 8/2002 Lee et al.
2002/0148959 A1 10/2002 Weiss et al.

FOREIGN PATENT DOCUMENTS

CA 2281405 3/2000

(Continued)

OTHER PUBLICATIONS

C N Booth, "Nuclear and Paricle Detectors", http://www-.shef.ac.uk/physics/teaching/phy311/semiconductor.html, Mar. 14, 2002.*

(Continued)

*Primary Examiner*—Milton Wells
*Assistant Examiner*—James J. Leuborne
(74) *Attorney, Agent, or Firm*—Diederiks & Whitelaw, PLC

(57) ABSTRACT

A mass spectrometer is disclosed having an ion guide which receives ions from either a pulsed ion source or an ion trap, or a continuous ion source. The ion guide emits packets of ions. The pulses of ions emitted from the ion guide may be synchronised with another device such as an ion detector, an orthogonal acceleration Time of Flight mass analyser, an ion trap or a mass filter.

79 Claims, 4 Drawing Sheets

FOREIGN PATENT DOCUMENTS

| | | |
|---|---|---|
| GB | 2 375 653 | 11/2002 |
| GB | 2 382 920 | 6/2003 |
| JP | 11-307040 | 11/1999 |
| JP | 2000-113852 | 4/2000 |
| JP | 2000-123780 | 4/2000 |
| WO | WO 94/01883 | 1/1994 |
| WO | WO 97/49111 | 12/1997 |
| WO | 98/06481 | 2/1998 |
| WO | 99/62101 | 12/1999 |
| WO | WO 01/15201 | 3/2001 |
| WO | WO 01/78106 | 10/2001 |
| WO | WO 02/43105 | 5/2002 |

OTHER PUBLICATIONS

Teloy et al., "Integral Cross Sections for Ion–Molecule Reactions. 1. The Guide Beam Technique", Chemical Physics 4, pp. 417–427, 1974.

Gerlich et al., "Ion Trap Studies of Association Processes in Collisions of $CH_3$ and $CD_3^+$ With $_{11}$–$H_2$, $D_2$ and He at 80 K", The Astrophysical Journal, vol. 347, pp. 849–854, 1989.

Guan et al., "Stacked–Ring Electrostatic Ion Guide", Journal of American Society for Mass Spectrometry, vol. 7, pp. 101–106.

Franzen et al., "Electrical Ion Guides", ASMS Book of Abstracts, pp. 1170, 1996.

Shaffer et al., "A Novel Ion Funnel for Ion Focusing at Elevated Pressures", ASMS Book of Abstracts, pp. 375, 1997.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Shaffer et al., "An Ion Funnel Interface for Improved Ion Focusing and Sensitivity Using Electrospray Ionization Mass Spectrometry", Analytical Chemistry, vol. 70, No. 19, pp. 4111–4119, 1998.

Shaffer et al., "Characterization of an Improved Electrodynamic Ion Funnel Interface for Electrospray Ionization Mass Spectrometry", Analytical Chemistry, vol. 71, No. 15, pp. 2957–2964, 1999.

Tolmachev et al., "Charge Capacity Limitations of Radio Frequency Ion Guides in Their Use for Improved Ion Accumulation and Trapping in Mass Spectrometry", Analytical Chemistry, vol. 72, No. 5, pp. 970–978, 2000.

Kim et al., "Design and Implementation of a New Electrodynamic Ion Funnel", Anaytical Chemistry, vol. 72, No. 10, pp. 2247–2255, 2000.

Luca et al., "On the Combination of a Linear Field Free Trap With a Time–Of–Flight Mass Spectrometer", Review of Scientific Instruments, vol. 72, No. 7, pp. 2900–2908, 2001.

Bateman et al., "Evaluation of a Stacked–Ring Radio Frequency Ion Transmission Device at Intermediate Pressures", ASMS, 2001.

Gerlich, "Inhomogeneous RF Fields: A Versitle Tool For the Study of Processes With Slow Ions", Advances in Chemical Physics Series, vol. 82, Chapter 1, pp. 1–176, 1992.

Gerlich, "Rf Ion Guides", Encyclopedia of Mass Spectrometry, vol. 5, pp. 1–34, 2003.

Masuda et al., "Separation of Small Particles Suspended in Liquid by Nonuniform Traveling Field", IEEE Transactions on Industry Applications, vol. 1A–23. No. 3, pp. 474–480, 1987.

Masuda et al., "Characteristics of Standing–Wave, Ring-Type Electric Curtain. Experimental Study", Electrical Engineering in Japan, vol. 93, No. 1, pp. 78–83, 1973.

Masuda et al., "Approximation for Calculating Nonuniform Traveling Fields", Electrical Engineering in Japan, vol. 96, No. 5, pp. 25–31, 1976.

Masuda et al., "Approximate or Calculating a Non–Uniform Traveling Field", Journal of Electrostatics, pp. 351–370, 1975.

Hu et al., "Design of Traveling–Wave Field Panel for Pharmaceutical Powders Based on Computer Simulation of Particle Trajectories", IEEE Transactions on Industry Applications, vol. 33, No. 3, pp. 641–650, 1997.

* cited by examiner

MASS SPECTROMETER

CROSS-REFERENCE TO RELATED APPLICATIONS

This application claims the benefit of the filing of U.S. Provisional Patent Application Ser. No. 60/421,764 filed Oct. 29, 2002.

BACKGROUND OF THE INVENTION

1. Field of the Invention

The present invention relates to a mass spectrometer and a method of mass spectrometry.

2. Discussion of the Prior Art

Mass spectrometers are known having an RF ion guide which comprises a multipole rod set wherein ions are radially confined within the ion guide by the application of an RF voltage to the rods. The RF voltage applied between neighbouring electrodes produces a pseudo-potential well or valley which radially confines ions within the ion guide.

RF ion guides are used, for example, to transport ions from an atmospheric pressure ion source through a vacuum chamber maintained at an intermediate pressure e.g. 0.001–10 mbar to a mass analyser maintained in a vacuum chamber at a relatively low pressure. Mass analysers which must be operated in a low pressure vacuum chamber include quadrupole ion traps, quadrupole mass filters, Time of Flight mass analysers, magnetic sector mass analysers and Fourier Transform Ion Cyclotron Resonance ("FTICR") mass analysers. The RF ion guides can efficiently transport ions despite the ions undergoing many collisions with gas molecules which cause the ions to be scattered and to lose energy since the RF radial confinement ensures that ions are not lost from the ion guide.

SUMMARY OF THE INVENTION

It is desired to provide an improved ion guide.

According to an aspect of the present invention there is provided a mass spectrometer comprising:

a device which repeatedly generates or releases packets of ions in a substantially pulsed manner; and an ion guide comprising a plurality of electrodes, the ion guide being arranged to receive packets of ions generated or released from the device and wherein in use one or more packets of ions generated or released from the device are trapped in one or more axial trapping regions within the ion guide and wherein the one or more axial trapping regions are translated along at least a portion of the axial length of the ion guide and ions are then released from the one or more axial trapping regions so that ions exit the ion guide in a substantially pulsed manner.

A characteristic of the preferred ion guide that distinguishes it from other ion guides is that ions exit the ion guide in a pulsed manner. This will be true irrespective of whether the ion beam entering the ion guide is continuous or pulsed. Hence the preferred ion is guide may be used to convert a continuous beam of ions into a pulsed beam of ions. Furthermore, the preferred ion guide may be used to transport a series of ion packets without allowing the ions to become dispersed and merged one with the next.

The pulsed nature of ions emitted from the ion guide advantageously allows the detection system to be phase locked with the ion pulses. For example, the detection system response may be modulated or pulsed in the same way the ion beam is modulated or pulsed. This provides a means of improving the signal to noise of the ion detection system since any continuous noise, white noise or DC offset in the detection system can be essentially eliminated from the detected signal.

The preferred ion guide may be advantageously interfaced with a discontinuous mass analyser. For example, the pulsing of an orthogonal acceleration Time of Flight mass spectrometer may be arranged to be synchronised with the frequency of a DC potential waveform passing along the ion guide to maximise the duty cycle for ions of a particular range of mass to charge ratios. The range of masses for which the duty cycle is maximised will be determined by the distance from the exit of the ion guide to the orthogonal acceleration region, the energy of the ions and the phase shift between that of the travelling DC waveform applied to the ion guide and that of the pulsing of the orthogonal acceleration Time of Flight mass spectrometer.

According to a first main embodiment a mass spectrometer is provided having an ion guide downstream of a device which repeatedly generates or releases packets of ions in a substantially pulsed manner. For example, the device may comprise a pulsed ion source, such as a Laser Desorption or ablation source or a Matrix Assisted Laser Desorption Ionisation ("MALDI") ion source. Alternatively, the device may comprise an ion trap wherein ions are released from the ion trap in a pulsed manner.

According to another aspect of the present invention there is provided a mass spectrometer comprising:

a device which generates or provides ions in a substantially continuous manner; and an ion guide comprising a plurality of electrodes, the ion guide being arranged to receive the ions from the device and wherein in use the ions received from the device are trapped in one or more axial trapping regions within the ion guide and wherein the one or more axial trapping regions are translated along at least a portion of the axial length of the ion guide and ions are then released from the one or more axial trapping regions so that ions exit the ion guide in a substantially pulsed manner.

According to the second main embodiment of the present invention the device may comprise a continuous ion source e.g. an Electrospray ("EST") ion source, an Atmospheric Pressure Chemical Ionisation ("APCI") ion source, an Atmospheric Pressure Photo Ionisation ("APPI") ion source, an Inductively Coupled Plasma ("ICP") ion source, an Electron Impact ("EI") ion source, an Chemical Ionisation ("CI") ion source, a Fast Atom Bombardment ("FAB") ion source or a Liquid Secondary Ions Mass Spectrometry ("LSIMS") ion source.

The device may according to a less preferred embodiment comprise a pulsed ion source in combination with a dispersing means for dispersing ions emitted by the pulsed ion source. The dispersed ions may therefore arrive at the ion guide in a substantially continuous or pseudo-continuous manner.

According to both main embodiments ions being transmitted through the ion guide are preferably substantially not fragmented within the ion guide. Accordingly, at least 50%, 60%, 70%, 80%, 90% or 95% of the ions entering the ion guide are arranged to have, in use, an energy less than 10 eV for a singly charged ion or less than 20 eV for a doubly charged ion such that the ions are substantially not fragmented within the ion guide.

A potential barrier between two or more trapping regions may be removed so that the two or more trapping regions become a single trapping region.

A potential barrier between two or more trapping regions may be lowered so that at least some ions are able to be move between the two or more trapping regions.

According to the preferred embodiment one or more transient DC voltages or one or more transient DC voltage waveforms are progressively applied to the electrodes so that ions trapped within one or more axial trapping regions are urged along the ion guide.

An axial voltage gradient may be maintained along at least a portion of the length of the ion guide wherein the axial voltage gradient varies with time whilst ions are being transmitted through the ion guide.

The ion guide may comprise a first electrode held at a first reference potential, a second electrode held at a second reference potential, and a third electrode held at a third reference potential, wherein:

at a first time $t_1$ a first DC voltage is supplied to the first electrode so that the first electrode is held at a first potential above or below the first reference potential;

at a second later time $t_2$ a second DC voltage is supplied to the second electrode so that the second electrode is held at a second potential above or below the second reference potential; and at a third later time $t_3$ a third DC voltage is supplied to the third electrode so that the third electrode is held at a third potential above or below the third reference potential.

Preferably, at the first time $t_1$ the second electrode is at the second reference potential and the third electrode is at the third reference potential;

at the second time $t_2$ the first electrode is at the first potential and the third electrode is at the third reference potential;

at the third time $t_3$ the first electrode is at the first potential and the second electrode is at the second potential.

Alternatively, at the first time $t_1$ the second electrode is at the second reference potential and the third electrode is at the third reference potential;

at the second time $t_2$ the first electrode is no longer supplied with the first DC voltage so that the first electrode is returned to the first reference potential and the third electrode is at the third reference potential; and at the third time $t_3$ the second electrode is no longer supplied with the second DC voltage so that the second electrode is returned to the second reference potential and the first electrode is at the first reference potential.

The first, second and third reference potentials are preferably substantially the same. Similarly, the first, second and third DC voltages may be substantially the same. The first, second and third potentials may also be substantially the same.

The ion guide may comprise 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential. A plurality of segments may be maintained at substantially the same DC potential.

Each segment may be maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions are preferably confined radially within the ion guide by an AC or RF electric field. Ions are preferably radially confined within the ion guide in a pseudo-potential well and are constrained axially by a real potential barrier or well.

According to the preferred embodiment the transit time of ions through the ion guide is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

The ion guide is preferably maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

The ion guide is preferably maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

The ion guide is preferably maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

According to the preferred embodiment the ion guide is maintained, in use, at a pressure such that a viscous drag is imposed upon ions passing through the ion guide.

Preferably, one or more transient DC voltages or one or more transient DC voltage waveforms are initially provided at a first axial position and are then subsequently provided at second, then third different axial positions along the ion guide.

Preferably, one or more transient DC voltages or one or more transient DC voltage waveforms move in use from one end of the ion guide to another end of the ion guide so that ions are urged along the ion guide.

The one or more transient DC voltages may create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells. The one or more transient DC voltage waveforms may comprise a repeating waveform such as a square wave.

The amplitude of the one or more transient DC voltages or the one or more transient DC voltage waveforms may remain substantially constant with time. Alternatively, the amplitude of the one or more transient DC voltages or the one or more transient DC voltage waveforms may vary with time. For example, the amplitude of the one or more transient DC voltages or the one or more transient DC voltage waveforms may either: (i) increase with time; (ii) increase then decrease with time; (iii) decrease with time; or (iv) decrease then increase with time.

The ion guide may comprise an upstream entrance region, a downstream exit region and an intermediate region, wherein:

in the entrance region the amplitude of the one or more transient DC voltages or the one or more transient DC voltage waveforms has a first amplitude;

in the intermediate region the amplitude of the one or more transient DC voltages or the one or more transient DC voltage waveforms has a second amplitude; and in the exit region the amplitude of the one or more transient DC voltages or the one or more transient DC voltage waveforms has a third amplitude.

The entrance and/or exit region may comprise a proportion of the total axial length of the ion guide selected from the group consisting of: (1) <5%; (ii) 5–10%; (iii) 10–15%; (iv) 15–20%; (v) 20–25%; (vi) 25–30%; (vii) 30–35%; (viii) 35–40%; and (ix) 40–45%.

Preferably, the first and/or third amplitudes are substantially zero and the second amplitude is substantially non-zero. The second amplitude is preferably larger than the first amplitude and/or the second amplitude is preferably larger than the third amplitude.

Preferably, the one or more transient DC voltages or one or more transient DC voltage waveforms pass in use along the ion guide with a first velocity and wherein the first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

The one or more transient DC voltages or the one or more transient DC voltage waveforms may cause ions within the ion guide to pass along the ion guide with a second velocity.

The difference between the first velocity and the second velocity is preferably less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

Preferably, the first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

Preferably, the second velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

The second velocity is preferably substantially the same as the first velocity.

The one or more transient DC voltages or the one or more transient DC voltage waveforms preferably have a frequency, and wherein the frequency: (i) remains substantially constant; (ii) varies; (iii) increases; (iv) increases then decreases; (v) decreases; or (vi) decreases then increases.

The one or more transient DC voltages and the one or more transient DC voltage waveforms preferably have a wavelength, and wherein the wavelength: (i) remains substantially constant; (ii) varies; (iii) increases; (iv) increases then decreases; (v) decreases; or (vi) decreases then increases.

According to an embodiment two or more transient DC voltages or two or more transient DC voltage waveforms pass simultaneously along the ion guide.

The two or more transient DC voltages or the two or more transient DC voltage waveforms may be arranged to move: (i) in the same direction; (ii) in opposite directions; (iii) towards each other; (iv) away from each other.

Preferably, one or more transient DC voltages or one or more transient DC voltage waveforms are repeatedly generated and passed in use along the ion guide, and wherein the frequency of generating the one or more transient DC voltages or the one or more transient DC voltage waveforms: (i) remains substantially constant; (ii) varies; (iii) increases; (iv) increases then decreases; (v) decreases; or (vi) decreases then increases.

The mass spectrometer preferably further comprises an ion detector, the ion detector being arranged to be substantially phase locked in use with the pulses of ions emerging from the exit of the ion guide.

The mass spectrometer preferably further comprises a Time of Flight mass analyser comprising an electrode for injecting ions into a drift region, the electrode being arranged to be energised in use in a substantially synchronised manner with the pulses of ions emerging from the exit of the ion guide.

The mass spectrometer may further comprise an ion trap arranged downstream of the ion guide, the ion trap being arranged to store and/or release ions from the ion trap in a substantially synchronised manner with the pulses of ions emerging from the exit of the ion guide.

The mass spectrometer nay further comprise a mass filter arranged downstream of the ion guide, wherein a mass to charge ratio transmission window of the mass filter is varied in a substantially synchronized manner with the pulses of ions emerging from the exit of the ion guide.

The ion guide may comprise an ion funnel comprising a plurality of electrodes having apertures therein through which ions are transmitted, wherein the diameter of the apertures becomes progressively smaller or larger. Alternatively, the ion guide may comprise an ion tunnel comprising a plurality of electrodes having apertures therein through which ions are transmitted, wherein the diameter of the apertures remains substantially constant. The ion guide may comprise a stack of plate, ring or wire loop electrodes.

Each electrode preferably has an aperture through which ions are transmitted in use. Each electrode preferably has a substantially circular aperture. Each electrode preferably has a single aperture through which ions are transmitted in use.

The diameter of the apertures of at least 50%, 60%, 70%, 80%, 90% or 95% of the electrodes forming the ion guide is preferably selected from the group consisting of; (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

Preferably, at least 50%, 60%, 70%, 80%, 90% or 95% of the electrodes forming the ion guide have apertures which are substantially the same size or area.

According to a less preferred embodiment the ion guide may comprise a segmented rod set.

The ion guide may consist of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

Preferably, the thickness of at least 50%, 60%, 70%, 80%, 90% or 95% of the electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The ion guide preferably has a length selected from the group consisting of: (i) less than 5 cm; (ii) 5–10 cm; (iii)

10–15 cm; (iv) 15–20 cm; (v) 20–25 cm; (vi) 25–30 cm; and (vii) greater than 30 cm.

Preferably, at least 10%, 20%, 30%, 40%, 50%, 60%, 70%, 80%, 90%, or 95% of the electrodes are connected to both a DC and an AC or RF voltage supply.

Preferably, axially adjacent electrodes are supplied with AC or RF voltages having a phase difference of 180°.

According to another aspect of the present invention there is provided a method of mass spectrometry comprising:

repeatedly generating or releasing packets of ions in a substantially pulsed manner;

receiving one or more packets of ions in an ion guide comprising a plurality of electrodes;

trapping the one or more packets of ions in one or more axial trapping regions within the ion guide;

translating the one or tore axial trapping regions along at least a portion of the axial length of the ion guide; and releasing ions from the one or more axial trapping regions so that ions exit the ion guide in a substantially pulsed manner.

According to another aspect of the present invention there is provided a method of mass spectrometry comprising:

generating or providing ions in a substantially continuous manner;

receiving the ions in an ion guide comprising a plurality of electrodes;

trapping the ions in one or more axial trapping regions within the ion guide;

translating the one or more axial trapping regions along at least a portion of the axial length of the ion guide; and releasing ions from the one or tore axial trapping regions so that ions exit the ion guide in a substantially pulsed manner Preferably, the method further comprises phase locking an ion detector to pulses of ions emerging from the exit of the ion guide.

Preferably, the method further comprises synchronising the energisation of an electrode for injecting ions into a drift region of a Time of Flight mass analyser to pulses of ions emerging from the exit of the ion guide.

Preferably, the method further comprises synchronising the storing and/or releasing of ions in an ion trap arranged downstream of the ion guide with the pulses of ions emerging from the exit of the ion guide.

Preferably, the method further comprises synchronising varying the mass to charge ratio transmission window of a mass filter arranged downstream of the ion guide with the pulses of ions emerging from the exit of the ion guide.

A repeating pattern of electrical DC potentials may be superimposed along the length of the ion guide so that a DC periodic waveform is formed. The DC potential waveform is arranged to travel along the ion guide in the direction and at a velocity at which it is desired to move ions along the ion guide.

The preferred ("travelling wave") ion guide may comprise an AC or RF ion guide such as a multipole rod set or stacked ring set which is segmented in the axial direction so that independent transient DC potentials may be applied to each segment. The transient DC potentials are superimposed on top of the RF confining voltage and any constant DC offset voltage. The DC potentials are changed temporally to generate a travelling DC potential wave in the axial direction.

At any instant in time a voltage gradient is generated between segments which acts to push or pull ions in a certain direction. As the voltage gradient moves in the required direction so do the ions. The individual DC voltages on each of the segments may be programmed to create a required waveform. Furthermore, the individual DC voltages on each of the segments may be programmed to change in synchronism so that the DC potential waveform is maintained but shifted in the direction in which it is required to move the ions.

The DC potential waveform may be superimposed on any nominally imposed constant axial DC voltage offset. No constant axial DC voltage gradient is required although the travelling DC wave may less preferably be provided in conjunction with an axial DC voltage gradient.

The transient DC voltage applied to each segment may be above or below that of a constant DC voltage offset applied to the electrodes forming the ion guide. The transient DC voltage causes the ions to move in the axial direction.

The transient DC voltages applied to each segment may be programmed to change continuously or in a series of steps. The sequence of voltages applied to each segment may repeat at regular intervals or at intervals that may progressively increase or decrease. The time over which the complete sequence of voltages is applied to a particular segment of the ion guide is the cycle time T. The inverse of the cycle time is the wave frequency f. The distance along the AC or RF ion guide over which the travelling DC waveform repeats itself is the wavelength λ. The wavelength divided by the cycle time is the velocity $v_{wave}$ of the travelling DC potential wave. Hence, the travelling wave velocity $V_{wave}$:

$$v_{wave} = \frac{\lambda}{T} = \lambda f$$

Under correct operation the velocity of the ions will be equal to that of the travelling DC potential wave. For a given wavelength the travelling DC wave velocity may be controlled by selection of the cycle time. If the cycle time T progressively increases then the velocity of the travelling DC wave will progressively decrease. The optimum velocity of the travelling DC potential wave may depend upon the mass of the ions and the pressure and composition of the background gas.

The travelling wave ion guide may be used at intermediate pressures between 0.0001 and 100 mbar, preferably between 0.001 and 10 mbar, for which the gas density will be sufficient to impose a viscous drag on the ions. The gas at these pressures will appear as a viscous medium to the ions and will act to slow the ions. The viscous drag resulting from frequent collisions with gas molecules will prevent the ions from building up excessive velocity. Consequently the ions will tend to ride on the travelling DC wave rather than run ahead of the wave and execute excessive oscillations within the travelling or translating potential wells which could lead to ion fragmentation.

The presence of the gas will impose a maximum velocity at which the ions will travel through the gas for a given field strength. The higher the gas pressure the more frequent the ion-molecule collisions and the slower the ions will travel for a given field strength. Furthermore, the energy of the ions will be dependent upon their mass and the square of their velocity. If fragmentation is to be avoided then the energy of the ions is preferably kept below a particular value usually below 5–10 eV. This consideration may impose a limit on the travelling wave velocity.

Since the preferred ion guide produces a pulsed beam of ions the repetition rate of the ion guide can be tailored to that of a mass analyser in terms of scan rates and acquisition times. For example, in a scanning quadrupole system the repetition rate may be high enough to prevent pulsing across the mass range. In a triple quadrupole tandem mass spectrometer operating in a MRM mode the repetition frequency may be compatible with the reaction monitoring dwell times. In a quadrupole Time of Flight tandem mass spectrometer the repetition frequency may be synchronised with the pusher pulses of the Time of Flight mass analyser to maximise ion sampling duty cycle and hence sensitivity.

Under conditions of intermediate gas pressures where ion-molecule collisions are likely to occur the travelling wave ion guide provides a means of ensuring ions exit the RF ion guide and of reducing their transit times.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
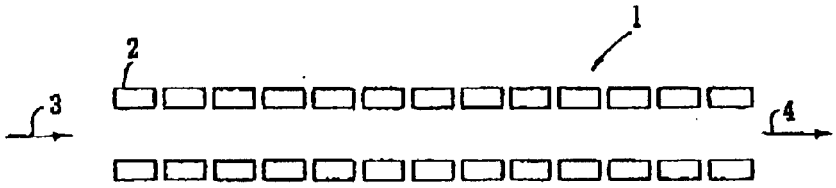
FIG. 1 shows a preferred ion guide.
Figure 2:
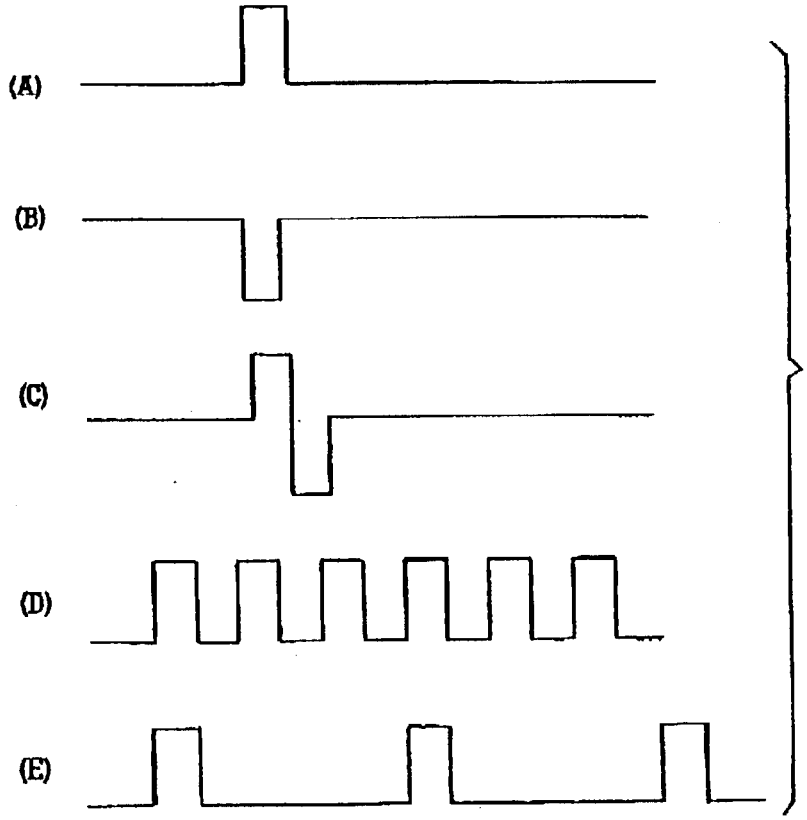
FIG. 2A shows a waveform with a single potential hill or barrier.
FIG. 2B shows a waveform with a single potential well.
FIG. 2C shows a waveform with a single potential well followed by a potential hill or barrier.
FIG. 2D shows a DC potential waveform with a repeating potential hill or barrier and FIG. 2E shows another DC potential waveform.

As shown in FIG. 1 the preferred embodiment relates to an AC or RF ion guide 1 comprising a plurality of electrodes 2. Ions arrive at an entrance 3 to the ion guide 1 and leave the ion guide 1 via an exit 4. The ion guide 1 may comprise a plurality of segments, each segment comprising one or more electrodes 2. The DC voltage applied to each segment may be programmed to change continuously or in a series of steps. The sequence of DC voltages applied to each segment may repeat at regular intervals or at intervals which may progressively increase or decrease. The time over which the complete sequence of DC voltages is applied to a particular segment is the cycle time T. The inverse of the cycle time is the wave frequency f. The distance along the AC or RF ion guide 1 over which the DC potential waveform repeats itself is the wavelength λ. The wavelength divided by the cycle time is the velocity $v_{wave}$ of the wave. Hence, the travelling wave velocity:

$$v_{wave} = \frac{\lambda}{T} = \lambda f$$

According to the preferred embodiment the velocity of the DC potential waveform which is progressively applied along the length of the ion guide 1 is arranged to substantially equal that of the ions arriving at the ion guide. For a given wavelength, the travelling wave velocity may be controlled by selection of the cycle time. If the cycle time T progressively increases then the velocity of the DC potential waveform will progressively decrease. The optimum velocity of the travelling DC potential waveform may depend on the mass of the ions and the pressure and composition of the gas in the ion guide 1.

The travelling wave ion guide 1 may be operated at intermediate pressures between 0.0001 and 100 mbar, preferably between 0.001 and 10 mbar, wherein the gas density will be sufficient to impose a viscous drag on the ions. The gas at these pressures will appear as a viscous medium to the ions and will act to slow the ions. The viscous drag resulting from frequent collisions with gas molecules prevents the ions from building up excessive velocity. Consequently, the ions will tend to ride on or with the travelling DC potential waveform rather than run ahead of the DC potential waveform and execute excessive oscillations within the potential wells which are being translated along the length of the ion guide 1.

The presence of a gas in the ion guide 1 imposes a maximum velocity at which the ions will travel through the gas for a given field strength. The higher the gas pressure the more frequent the ion-molecule collisions and the slower the ions will travel for a given field strength. Furthermore, the energy of the ions will be dependent upon their mass and the square of their velocity. If fragmentation is not desired, then the energy of the ions is preferably kept below about 5–10 eV. This may impose a limit on the velocity of the DC potential waveform. Consequently, the optimum DC potential wave velocity will vary with the mass of the ion, the gas pressure and whether it is desired to transport ions with minimal fragmentation or to fragment ions.

A feature of the preferred ion guide 1 is that it emits a pulsed beam of ions. The repetition rate of the pulses of ions can be tailored to a mass analyser downstream of the ion guide 1 in terms of scan rates and acquisition times. For example, in a scanning quadrupole system the repetition rate can be made high enough to prevent pulsing across the mass range. In a triple quadrupole tandem mass spectrometer operating in a MRM mode the repetition frequency may be made compatible with the reaction monitoring dwell times. With a quadrupole Time of Flight tandem mass spectrometer, the repetition frequency may be synchronised with the pusher pulses on the Time of Flight mass analyser to maximise ion sampling duty cycle and hence sensitivity.

The pulses of ions emitted from the ion guide 1 may also be synchronised with the operation of an ion trap or mass filter.

According to one embodiment the transient DC potential waveform applied to the ion guide 1 may comprise a square wave. The amplitude of the DC waveform may become progressively attenuated towards the entrance of the ion guide 1 i.e. the amplitude of the travelling potential DC waveform may grow to its full amplitude over the first few segments of the travelling wave ion guide 1. This allows ions to be introduced into the ion guide 1 with minimal disruption to their sequence. A continuous ion beam arriving at the entrance 3 to the ion guide 1 will advantageously exit the ion guide 1 as a series of pulses.

One example of an advantage to be gained from converting a continuous beam of ions into a pulsed beam of ions is that it allows the detection system to be phase locked with the ion pulses. The detection system response may be modulated or pulsed in the same way the ion beam is modulated or pulsed. This provides a means of improving the signal to noise of the ion detection system since any continuous noise, white noise, or DC offset in the detection system may be substantially eliminated from the detected signal.

Another example of an advantage to be gained from converting a continuous beam of ions into a pulsed beam of ions is that gained when the travelling wave ion guide 1 is interfaced to a discontinuous mass analyser. For example, the pulsing of an orthogonal acceleration Time of Flight mass spectrometer may be synchronised with the travelling wave frequency to maximise the duty cycle for ions having a particular range of mass to charge ratios. The range of masses for which the duty cycle is maximised will be determined by the distance from the exit of the travelling wave ion guide 1 to the orthogonal acceleration region, the energy of the ions and the phase shift between that of the travelling waveform and that of the pulsing of the orthogonal acceleration Time of Flight mass spectrometer.

A further advantage of the preferred ion guide 1 is that a pulse of ions arriving at the entrance to the travelling wave ion guide 1 can be arranged to also exit the ion guide 1 as a pulse of ions. The pulse of ions arriving at the travelling wave ion guide 1 is preferably synchronised with the travelling waveform so that the ions arrive at the optimum phase of that waveform. In other words, the arrival of the ion pulse should preferably coincide with a particular phase of the waveform. This characteristic of the travelling wave ion guide 1 is an advantage when used with a pulsed ion source, such as a laser ablation source or MALDI source or when ions have been released from an ion trap and it is desired to substantially prevent the pulse of ions from becoming dispersed and broadened. The preferred embodiment is therefore particularly advantageous for transporting ions to an ion trap or to a discontinuous mass analyser such as a quadrupole ion trap, FTICR mass analyser or Time of Flight mass analyser.

An ion guide 1 according to a preferred embodiment comprises a stacked ring AC or RF ion guide. The complete stacked ring set is preferably 180 mm long and is made from 120 stainless steel rings each preferably 0.5 mm thick and spaced apart by 1 mm. The internal aperture in each ring is preferably 5 mm in diameter. The frequency of the RF supply is preferably 1–75 MHz and the peak RF voltage may be varied up to 500. The stacked ring ion guide 1 may be mounted in an enclosed collision cell chamber positioned between two quadrupole mass filters in a triple quadrupole mass spectrometer. The pressure in the enclosed collision cell chamber may be varied up to 0.01 mbar. The stacked ring RP ion guide is preferably electrically divided into 15 segments each 12 mm long and consisting of 8 rings. Three different DC voltages may be connected to every third segment so that a sequence of voltages applied to the first three segments is repeated a further four times along the whole length of the stacked ring set. The three DC voltages applied to every third segment may be independently programmed up to 40 volts. The sequence of voltages applied to each segment preferably creates a waveform with a potential hill, repeated five times throughout the length of the stacked ring set. Hence the wavelength of the travelling waveform is preferably 36 mm (3×12 mm). The cycle time for the sequence of voltages on any one segment is preferably 23 μsec and hence the wave velocity is preferably 1560 m/s (36 mm/23 μs).

Figure 3:
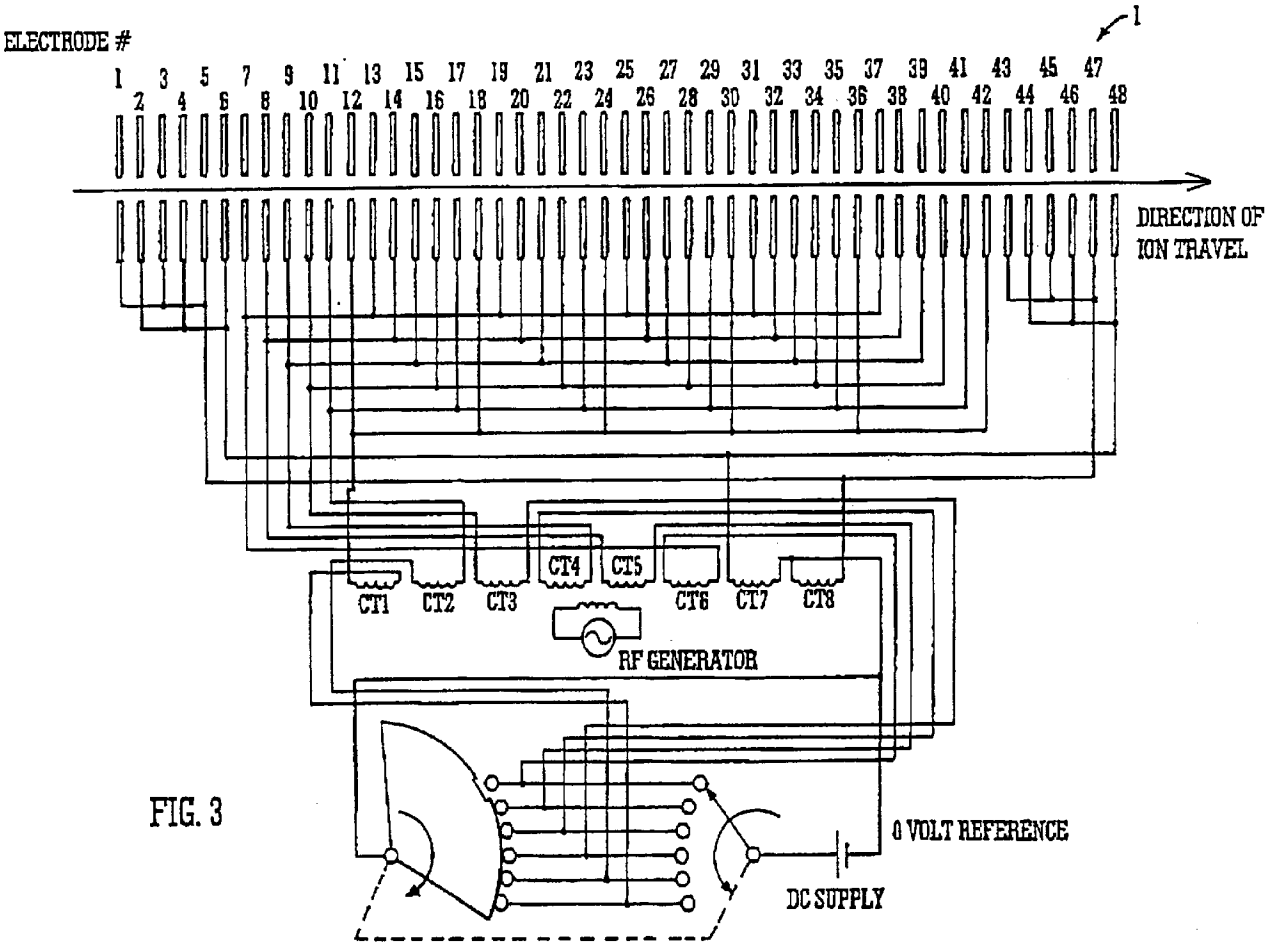
FIG. 3 illustrates how a repeating transient DC voltage waveform may be generated.

The operation of a travelling wave ion guide 1 will now be described with reference to FIG. 3. The preferred embodiment preferably comprises 120 electrodes but 48 electrodes are shown in FIG. 3 for ease of illustration.

Alternate electrodes are preferably fed with opposite phases of a RF supply (preferably 1 MHz and 500 V p-p). The ion guide 1 may be divided into separate groups of electrodes (6 groups of electrodes are shown in FIG. 3). The electrodes in each group may be fed from separate secondary windings on a coupling transformer as shown in FIG. 3. These are connected so that all the even-numbered electrodes are 180° out of phase with all the odd-numbered electrodes. Therefore, at the point in the RF cycle when all the odd numbered electrodes are at the peak positive voltage, all the even-numbered electrodes are at the peak negative voltage.

Groups of electrodes at each end of the ion guide 1 (e.g. electrodes #1–6 and #43–48) may be supplied with RF only potentials whereas the central groups (e.g. electrodes #7–12, #13–18, #19–24, #25–30, #31–36 and #37–42) may be supplied with both RF and DC potentials. Electrodes #1, #3, #5, #43, #45 and #47 may be connected to one pole of the secondary winding CT8 and electrodes #2, #4, #6, #44, #46 and #48 may be connected to the opposite end of winding CT7 to ensure the correct RF phasing of the electrodes. The other ends of these windings are connected to the 0 V DC reference so that only RF potentials are applied to the end groups of electrodes. Electrodes #7, #13, #19, #24, #31 and #37 which are the first electrodes of each of the central groups are connected together and fed from secondary winding CT6. Windings CT5, CT4, CT3, CT2 and CT1 respectively supply the second through sixth electrodes of each of central groups. Each of windings CT1-6 is referred to a different DC reference point shown schematically by the 2-gang switch in FIG. 3 so that the first through sixth sets of electrodes of the central groups of electrodes can be supplied with a DC potential selected by the switch, as well as the RF potentials.

In the preferred mode of operation only one set of interconnected electrodes comprised in the central groups is supplied with a DC voltage at any given instant. All the other windings are referenced to 0V DC at that particular instant. For example, with the switch in the position illustrated in FIG. 3, winding CT6 of the transformer may be connected to the DC supply biasing all the first electrodes (e.g. electrodes #7, #13, #19 etc.) of the central groups relative to all other electrodes.

If the switch is then moved to the next position, winding CT5 is connected to the DC supply, biasing all the second electrodes (e.g. electrodes #8, #14, #20 etc.) while the first electrodes (e.g. electrodes #7, #13, #19 etc.) are returned to 0 V DC.

When used as a travelling wave ion guide 1 the switch can be effectively rotated continuously biasing in turn the first through sixth electrodes and then repeating the sequence without interruption. A mechanical switch is shown in FIG. 3 for sake of illustration. Electronic switching may more preferably be used to carry out the switching. Each transformer winding CT1-8 may be fed by a Digital to Analogue Converter which can apply the desired DC potential to the winding under computer control.

Typical operating conditions may have an RF peak-to-peak voltage of 500 V, an RF frequency of 1 MHz, a DC bias of +5 V (for positive ions) and a switching frequency of 10–100 kHz.

If a positive ion enters the ion guide 1 when the switch is in the position shown in FIG. 3 and a positive DC potential is applied to electrode #7 then the ion will encounter a potential barrier at electrode #7 which prevents its further passage along the ion guide 1 (assuming that its translational kinetic energy is not too high). As soon as the switch moves to the next position, however, this potential barrier will shift to electrode #8 and then electrode #9, #10, #11 and #12 upon further rotation of the switch. This allows the ion to move further along the ion guide 1. On the next cycle of operation of the switch, the barrier in front of the ion moves to electrode #13 and a new potential barrier now appears on electrode #7 behind the ion. The ion therefore becomes contained or otherwise trapped in a potential well between the potential barriers on electrodes #7 and #13. Further rotation of the switch moves this potential well from electrodes #7–13 to electrodes #8–14, then #9–15, through to #12–18. A further cycle of the switch moves this potential well in increments of one electrode from electrodes #12–18 through to electrodes #18–24. The process repeats thereby pushing the ion along the ion guide 1 in its potential well until it emerges into the RF only exit group of electrodes #43–48 and then subsequently leaves the ion guide 1.

As a potential well moves along the ion guide 1, new potential wells capable of containing more ions may be created and moved along behind it. The travelling wave ion guide 1 therefore carries individual packets of ions along its length in the travelling potential wells while simultaneously the strong focusing action of the RF field tends to confine the ions to the axial region.

According to a particularly preferred embodiment a mass spectrometer is provided having two quadrupole mass filters/analysers and a collision cell. A travelling wave ion guide 1 may be provided upstream of the first mass filter/analyser. A transient DC potential waveform may be applied to the travelling wave ion guide 1 having a wavelength of 14 electrodes. The DC voltage is preferably applied to neighbouring pairs of electrodes 2 and is preferably stepped in pairs. Hence, according to the preferred embodiment there are seven steps in one cycle. Therefore, at any one time there are two electrodes with a transient applied DC voltage followed by 12 electrodes with no applied DC voltage followed by two electrodes with a transient applied DC voltage followed by 12 electrodes with no applied DC voltage etc.

A buffer gas (typically nitrogen or helium) may be introduced into the travelling wave ion guide 1. If the ion guide 1 is used to interface a relatively high pressure source to a high-vacuum mass analyser or is used as a collision cell then gas will already be present in the ion guide 1. The buffer gas is a viscous medium and is preferably provided to dampen the motion of the ions. The presence of gas tends to thermalise the ion translational energies. Therefore, ions entering the ion guide 1 may become thermalised by collisional cooling irrespective of the kinetic energy possessed by the ions and they will be confined in their potential wells as they travel through the ion guide 1. Assuming that the potential barriers are sufficiently high to ensure the ions remain in the potential well, their transit time through the ion guide 1 will be independent of both their initial kinetic energy and the gas pressure. The ion transit time will therefore be determined solely by the rate at which the potential wells are moved or translated along the ion guide 1 and will be a function of the switching rate of the electrode potentials. This property can be exploited advantageously in a number of applications and leads to improvements in performance when compared to instruments using conventional rod-set guides in which this control is unavailable.

Figure 4:
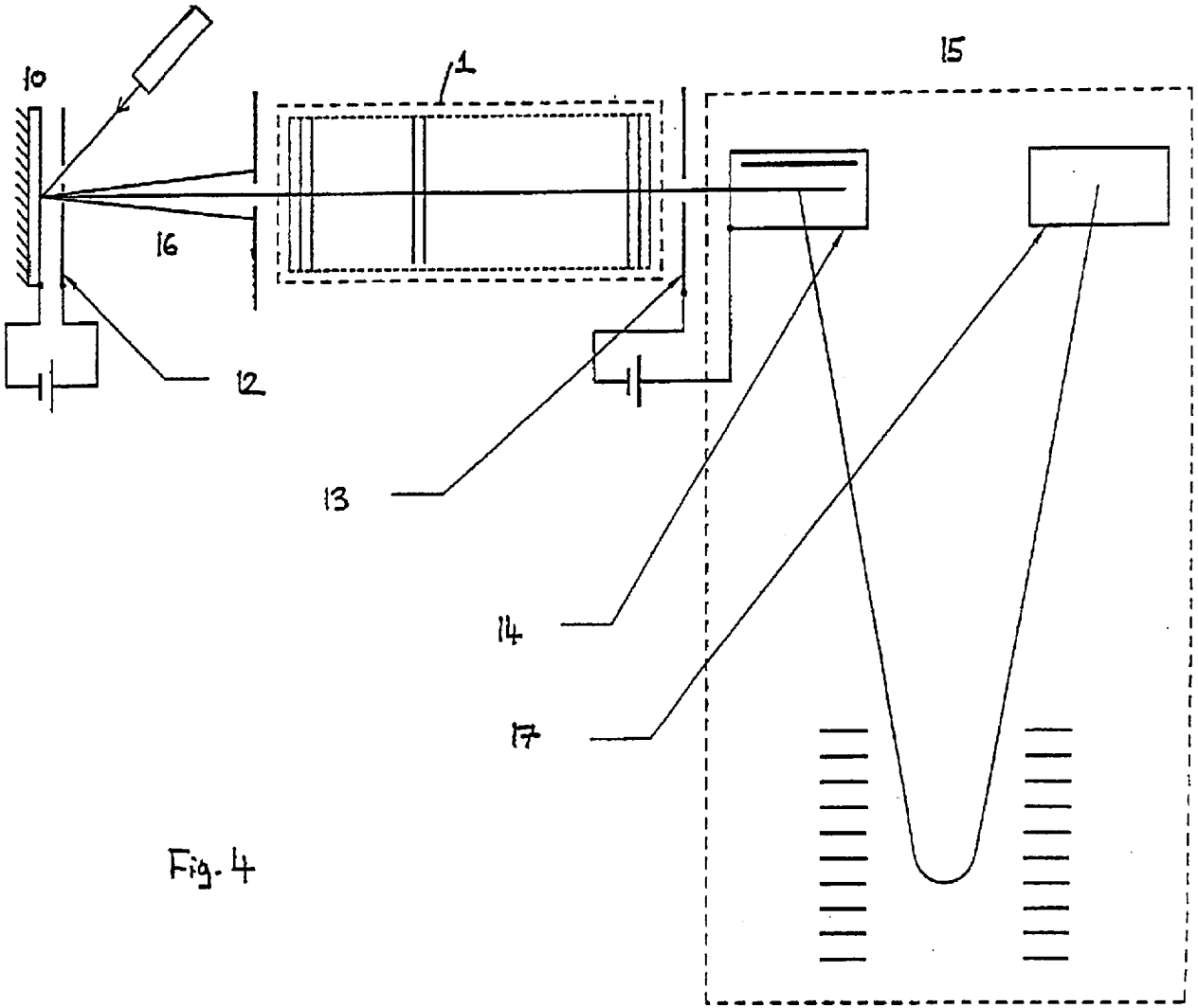
FIG. 4 shows an embodiment of the present invention.

A particularly preferred embodiment is shown in FIG. 4. The travelling wave ion guide 1 advantageously allows the ion transit time to be controlled unlike other ion guides and in particular allows a MALDI-TOF instrument to be operated in a very efficient way with virtually a 100% ion transmission and analysis efficiency.

A sample to be analysed is coated on a target 10 and is bombarded with photons from a laser 11. Ions so produced pass through an aperture in an extraction electrode 12 and then through a travelling wave ion guide 1 according to the preferred embodiment. On exiting the travelling wave ion guide 1 they pass through an exit electrode 13 and enter the pulser 14 of a Time of Flight mass analyser 15. A linear or a reflecting Time of Flight mass analyser 15 may be provided. An orthogonal reflecting type is preferred and is shown in FIG. 4. Operation of the pulser 14 and Time of Flight mass analyser 15 is conventional. Gas (e.g. nitrogen) may be introduced into the travelling wave ion guide 1 at e.g. a pressure of between $10^{-3}$ and 1 mbar in order to provide collisional cooling of the ions as they are carried through the travelling wave ion guide 1.

An accelerating region is preferably provided between the target 10 and the extraction electrode 12 and a 10 V potential gradient may be provided to accelerate positive ions as shown. This region is preferably followed by a field-free region 16 between the extraction electrode 12 and the entrance of the travelling wave ion guide 1. According to an embodiment the length of the field free region 16 is 250 mm.

Another accelerating field may be provided between the travelling wave ion guide exit electrode 13 and the Time of Flight pulser 14, as shown. A 40 V potential gradient may, for example, be provided in this region. The accelerating fields and the field-free region 16 interact with the operation of the travelling wave ion guide 1 to enable a mode of operation which is highly efficient. The ion source, acceleration regions and field-free region 16 are preferably maintained at relatively high vacuum.

It is known that the majority of ions ejected from the MALDI target 10 will have a range of velocities typically between about 0.5 and 2.0 times the speed of sound, on average about 300–400 m/s. This spread in velocities accounts for the relatively large spread in ion energies. In the embodiment shown in FIG. 4 an accelerating field exists between the target 10 and the extraction electrode 12 so that the ions gain an equal amount of kinetic energy on passing through the field which adds a mass dependent component of velocity to their approximately constant ejection velocity. Since kinetic energy KE:

$$KE = \frac{mv^2}{2}$$

then if the energy is constant, the added velocity is proportional to $1/\sqrt{m}$.

The ions then enter a field-free drift region 16 between the extraction electrode 12 and the entrance of the travelling wave ion guide 1 in which they begin to separate according to their mass to charge ratios because of the different mass-dependent velocities imparted to them during the prior acceleration stage. Consequently, the lightest ions arrive first at the entrance to the travelling wave ion guide 1. These ions will enter the travelling wave ion guide 1 and become trapped in a DC potential well. As that DC potential well moves or is translated along the length of travelling wave ion guide 1, a second DC potential well opens behind it into which some slightly heavier ions will become trapped. These ions will have taken slightly longer to reach the travelling wave ion guide entrance because they will have moved slightly tore slowly through the field free region 16 than the lightest ions. Thus it will be seen that the combined effect of the accelerating region, field-free region 16 and the travelling DC potential wells of the travelling wave ion guide 1 results in a series of DC potential wells reaching the end of the travelling wave ion guide 1 with each potential well or trapping region containing ions of similar mass to charge ratios. The first potential well or trapping region arriving at the exit of the travelling wave ion guide 1 will contain the lightest ions, the following potential wells or trapping regions will contain ions of steadily increasing mass to charge ratios and the last potential well or trapping region will contain the heaviest ions from any particular laser pulse.

Since the ions remain trapped in their potential wells during their passage or translation through the traveling wave ion guide 1, the ions preferably do not mix with ions in different potential wells. Since gas is present in the travelling wave ion guide 1 this results in collisional cooling of the ions in each potential well whilst the travelling potential well continues to push the ions forward at a velocity equal to that of the potential well. Consequently, by the time the ions reach the end of the travelling wave ion guide 1 the ions in each potential well will have lost most of their initial velocity spread even though they have a bulk velocity equal to that of the potential well. In other words, their initial relatively large spread in energy is reduced to that of the thermal energy of the buffer gas.

When the first potential well (containing the lightest ions with substantially only thermal energies) reaches the end of the travelling wave ion guide 1 the front potential barrier disappears and the rear potential barrier pushes the ions out of the travelling wave ion guide 1 into another accelerating field between the exit of the travelling wave ion guide 1 and the pusher electrodes of the Time of Flight mass analyser 15. Typically, a gradient of about 40 V may be applied. This field rapidly accelerates the ions into the pusher region 14, but because they all start with similar (very low) kinetic energy and because the potential well contains only ions having a limited range of masses, the ions do not significantly separate in space during this acceleration. The slowest ions released from the potential well will therefore still enter the pusher region 14 before the fastest ions can exit the pusher region 14. Consequently, if the pusher voltage is applied at this precise time then all the ions contained in a particular potential well or trapping region can be analysed by the Time of Flight mass analyser 15 without loss. Advantageously, a single TOF push, synchronised with but delayed from the arrival of a potential well at the exit of the travelling wave ion guide 1 may be used to analyse all the ions in a potential well. The preferred embodiment is therefore capable of mass analysing all the ions from a given laser pulse with virtually a 100% efficiency.

The preferred embodiment can be yet further refined by varying the travelling wave ion guide switching speed during the arrival of ions at the travelling wave ion guide 1 following a laser pulse. The collection of ions into individual potential wells will proceed with least disruption to their grouping by mass to charge ratio if the velocity of the potential wells is arranged to substantially match the velocities of the ions arriving at the entrance to the travelling wave ion guide 1. The ions arriving at the travelling wave ion guide 1 from each laser pulse will have progressively slower velocities as the elapsed time from the laser pulse increases as their velocity is simply the length of the field free region 16 from the target plate 10 to the travelling wave ion guide 1 divided by the elapsed time. Accordingly, the velocity of the potential wells in the travelling wave ion guide 1 may be continuously reduced so as to continuously match the velocity of the ions arriving at the entrance of the travelling wave ion guide 1. This can be achieved by arranging the travelling wave ion guide switching time intervals to increase linearly with elapsed time from the laser pulse.

As a consequence, the velocities of the ions within potential wells within the travelling wave ion guide 1 will also preferably continuously reduce. Since the ions have a natural tendency to slow due to the viscous drag of the collision gas, by appropriate selection of gas type and pressure the natural slowing of ions due to viscous drag can be made to substantially match the slowing velocity of the potential wells in the travelling wave ion guide 1 thereby reducing the chances of any ions fragmenting unintentionally in the ion guide 1.

Another advantage of this arrangement is that the energy of the ions leaving the travelling wave ion guide 1 is approximately constant (otherwise, the energy of the ions would increase with the increasing mass of the ions in the later arriving potential wells). The ions therefore leave the travelling wave ion guide 1 with substantially the velocity of the potential barriers moving along the travelling wave ion guide 1. If the traveling DC wave velocity is kept constant then ions with higher masses will have greater kinetic energies than ions with lower masses. However, ions entering an orthogonal Time of Flight mass analyser 15 should preferably all have approximately the same energy in order to avoid spatial separation of ions when they arrive at the ion detector 17. It is therefore necessary for all ions to have substantially the same energy in order to ensure that all the ions ultimately hit the ion detector 17. This can be achieved by reducing the velocity of the potential barriers as the heavier masses arrive at and leave the travelling wave ion guide 1. If the velocity of the potential wells is reduced by arranging the travelling wave ion guide switching time intervals to increase linearly with elapsed time from the laser pulse, then the ions all advantageously exit the travelling wave ion guide 1 with approximately the same energy independent of their mass.

In order to allow for the lower velocity of the higher mass ions, the delay between the arrival of a potential well at the exit of the travelling wave ion guide 1 and the operation of the Time of Flight pulser 14 is preferably increased in synchronism with the increased switching time intervals of the travelling wave ion guide operation.

A theoretical treatment of the effect of gas collisions in the travelling wave ion guide 1 or the transport of ions in the potential well shows that the potential well translation velocity (i.e. the switching speed of the travelling wave ion guide) should be reduced exponentially during the time the laser desorbed ions are arriving at the travelling wave ion guide.

Figure 5:
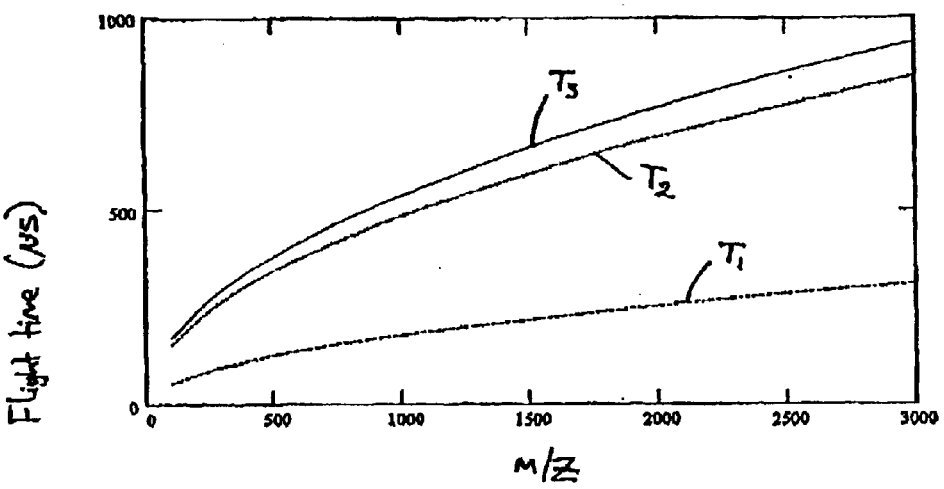
FIG. 5 shows a graph illustrating the arrival time $T_1$ of ions arriving at a preferred ion guide, the time $T_2$ that the ions exit the preferred ion guide and the arrival time $T_3$ of the ions at a pusher electrode of an orthogonal acceleration Time of Flight mass analyser for ions of varying mass to charge ratio.

FIG. 5 illustrates how ions of differing mass to charge ratios will arrive at the travelling wave ion guide 1 shown in FIG. 4 as a function of time $T_1$. FIG. 5 also illustrates the exit time $T_2$ of the ions from the travelling wave ion guide 1 and the arrival time $T_3$ of the ions at the orthogonal acceleration Time of Flight mass analyser 15.

The curves shown in FIG. 5 assume that ions are released or generated at time T=0 and are accelerated by a voltage $V_1$ of 10 V. The ions will therefore have an energy of $E_1$ (eV) where $E_1$=10. The distance $L_1$ (m) from the pulsed ion source 10,11 to the entrance of the travelling wave ion guide 1 is 0.25 m. The arrival time $T_1$ for ions at the entrance to the travelling wave ion guide 1 is therefore given by:

$$T_1 = 72L_1\sqrt{\frac{m}{E_1}}$$

The velocity v (m/s) of the transient DC voltage waveform and/or of the ions arriving at the travelling wave ion guide 1 is given by:

$$v = \frac{L_1}{T_1} \cdot 10^6$$

The length $L_2$ (m) of the travelling wave ion guide is 0.25 m. The time $T_2$ at which ions exit the travelling wave ion guide 1 is given by:

$$T_2 = T_1 e^{\left(\frac{L_2}{L_1}\right)}$$

The velocity $v_x$ of the transient DC voltage waveform and/or the ions at the exit of the travelling wave ion guide 1:

$$v_x = v e^{-\left(\frac{L_2}{L_1}\right)}$$

The energy $E_2$ (eV) of ions at the exit of the travelling wave ion guide 1 is:

$$E_2 = E_1 e^{-2\left(\frac{L_2}{L_1}\right)}$$

and hence;

$$E_2 = 1.353$$

The ions are further accelerated by a voltage $V_3$ (V) at the exit of the travelling wave ion guide 1:

$$V_3 = 38.647$$

The energy $E_3$ (eV) of the ions therefore after acceleration:

$$E_3 = E_2 + V_3$$

where $E_3$=40. The path length $L_3$ (m) from the travelling wave ion guide 1 to the orthogonal acceleration pusher region is 0.15 m. The flight time $T_x$ from the exit of the travelling wave ion guide 1 to the orthogonal acceleration pusher region 14:

$$T_x = 72 L_3 \sqrt{\frac{m}{E_3}}$$

The arrival time $T_3$ at the orthogonal acceleration pusher region:

$$T_3 = T_2 + T_x$$

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a device which repeatedly generates or releases packets of ions in a substantially pulsed manner; and an ion guide comprising a plurality of electrodes, said ion guide being arranged downstream of the device to receive packets of ions generated or released from said device and wherein in use one or more packets of ions generated or released from said device are trapped in one or more axial trapping regions within said ion guide and wherein said one or more axial trapping regions are translated along at least a portion of the axial length of said ion guide and ions are then released from said one or more axial trapping regions so that ions exit said ion guide in a substantially pulsed manner.

2. A mass spectrometer as claimed in claim 1, wherein said device comprises a pulsed ion source.

3. A mass spectrometer as claimed in claim 2, wherein said pulsed ion source is selected from the group consisting of: (i) a Matrix Assisted Laser Desorption Ionisation ("MALDI") ion source; and (ii) a Laser Desorption Ionisation ("LDI") ion source.

4. A mass spectrometer as claimed in claim 1, wherein said device comprises an ion trap arranged upstream of said ion guide.

5. A mass spectrometer comprising:

a device which generates or provides ions in a substantially continuous manner; and an ion guide comprising a plurality of electrodes, said ion guide being arranged to receive said ions from said device and wherein in use said ions received from said device are trapped in one or more axial trapping regions within said ion guide and wherein said one or more axial trapping regions are translated along at least a portion of the axial length of said ion guide and ions are then released from said one or more axial trapping regions so that ions exit said ion guide in a substantially pulsed manner.

6. A mass spectrometer as claimed in claim 5, wherein said device comprises a continuous ion source.

7. A mass spectrometer as claimed in claim 6, wherein said continuous ion source is selected from the group consisting of; (i) an Electrospray ("ESI") ion source; (ii) an Atmospheric Pressure Chemical ionisation ("APCI") ion source; (iii) an Atmospheric Pressure Photo ionisation ("APPI") ion source; (iv) an Inductively Coupled Plasma ("ICP") ion source; (v) an Electron Impact ("EI") ion source; (vi) an Chemical ionisation ("CI") ion source; (vii) a Fast Atom Bombardment ("FAB") ion source; and (viii) a Liquid Secondary Ions Mass Spectrometry ("LSIMS") ion source.

8. A mass spectrometer as claimed in claim 5, wherein said device comprises a pulsed ion source in combination with a dispersing means for dispersing ions emitted by said pulsed ion source.

9. A mass spectrometer as claimed in claim 8, wherein said ions arrive at said ion guide in a substantially continuous or pseudo-continuous manner.

10. A mass spectrometer as claimed in claim 5, wherein ions being transmitted through said ion guide are substantially not fragmented within said ion guide.

11. A mass spectrometer as claimed in claim 5, wherein at least 50%, 60%, 70%, 80%, 90% or 95% of the ions entering said ion guide are arranged to have, in use, an energy less than 10 eV for a singly charged ion or less than 20 eV for a doubly charged ion such that said ions are substantially not fragmented within said ion guide.

12. A mass spectrometer as claimed in claim 5, wherein a potential barrier between two or more trapping regions is removed so that said two or more trapping regions become a single trapping region.

13. A mass spectrometer as claimed in claim 5, wherein a potential barrier between two or more trapping regions is lowered so that at least some ions are able to be move between said two or more trapping regions.

14. A mass spectrometer as claimed in claim 5, wherein, in use, one or more transient DC voltages or one or more transient DC voltage waveforms are progressively applied to said electrodes so that ions trapped within one or more axial trapping regions are urged along said ion guide.

15. A mass spectrometer as claimed in claim 5, wherein in use an axial voltage gradient is maintained along at least a portion of the length of said ion guide and wherein said axial voltage gradient varies with time whilst ions are being transmitted through said ion guide.

16. A mass spectrometer as claimed in claim 5, wherein said ion guide comprises a first electrode held at a first reference potential, a second electrode held at a second reference potential, and a third electrode held at a third reference potential, wherein:

at a first time $t_1$ a first DC voltage is supplied to said first electrode so that said first electrode is held at a first potential above or below said first reference potential;

at a second later time $t_2$ a second DC voltage is supplied to said second electrode so that said second electrode is held at a second potential above or below said second reference potential; and at a third later time $t_3$ a third DC voltage is supplied to said third electrode so that said third electrode is held at a third potential above or below said third reference potential.

17. A mass spectrometer as claimed in claim 16, wherein:

at said first time $t_1$ said second electrode is at said second reference potential and said third electrode is at said third reference potential;

at said second time $t_2$ said first electrode is at said first potential and said third electrode is at said third reference potential;

at said third time $t_3$ said first electrode is at said first potential and said second electrode is at said second potential.

18. A mass spectrometer as claimed in claim 16, wherein:

at said first time $t_1$ said second electrode is at said second reference potential and said third electrode is at said third reference potential;

at said second time $t_2$ said first electrode is no longer supplied with said first DC voltage so that said first electrode is returned to said first reference potential and said third electrode is at said third reference potential; and at said third time $t_3$ said second electrode is no longer supplied with said second DC voltage so that said second electrode is returned to said second reference potential and said first electrode is at said first reference potential.

19. A mass spectrometer as claimed in claim 16, wherein said first, second and third reference potentials are substantially the same.

20. A mass spectrometer as claimed in claim 16, wherein said first, second and third DC voltages are substantially the same.

21. A mass spectrometer as claimed in claim 16, wherein said first, second and third potentials are substantially the same.

22. A mass spectrometer as claimed in claim 5, wherein said ion guide comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

23. A mass spectrometer as claimed in claim 22, wherein a plurality of segments are maintained at substantially the same DC potential.

24. A mass spectrometer as claimed in claim 22, wherein each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

25. A mass spectrometer as claimed in claim 5, wherein ions are confined radially within said ion guide by an AC or RF electric field.

26. A mass spectrometer as claimed in claim 5, wherein ions are radially confined within said ion guide in a pseudo-potential well and are constrained axially by a real potential barrier or well.

27. A mass spectrometer as claimed in claim 5, wherein the transit time of ions through said ion guide is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

28. A mass spectrometer as claimed in claim 5, wherein said ion guide is maintained at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

29. A mass spectrometer as claimed in claim 5, wherein said ion guide is maintained at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) lees than or equal to 0.001 mbar; (x) less than or equal to 0.0005 mbar; and (xi) less than or equal to 0.0001 mbar.

30. A mass spectrometer as claimed in claim 5, wherein said ion guide is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

31. A mass spectrometer as claimed in claim 5, wherein said ion guide is maintained, in use, at a pressure such that a viscous drag is imposed upon ions passing through said ion guide.

32. A mass spectrometer as claimed in claim 5, wherein in use one or more transient DC voltages or one or more transient DC voltage waveforms are initially provided at a first axial position and are then subsequently provided at second, then third different axial positions along said ion guide.

33. A mass spectrometer as claimed in claim 5, wherein in use one or more transient DC voltages or one or more transient DC voltage waveforms move in use from one end of said ion guide to another end of said ion guide so that ions are urged along said ion guide.

34. A mass spectrometer as claimed in claim 32, wherein said one or more transient DC voltages create; (i) a potential hill or barrier; (ii) a potential well: (iii) multiple potential hills or barriers; (iv) multiple potential wells; (v) a combination of a potential hill or barrier and a potential well; or (vi) a combination of multiple potential hills or barriers and multiple potential wells.

35. A mass spectrometer as claimed in claim 32, wherein said one or more transient DC voltage waveforms comprise a repeating waveform.

36. A mass spectrometer as claimed in claim 35, wherein said one or more transient DC voltage waveforms comprise a square wave.

37. A mass spectrometer as claimed in claim 32, wherein the amplitude of said one or more transient DC voltages or said one or more transient DC voltage waveforms remains substantially constant with time.

38. A mass spectrometer as claimed in claim 32, wherein the amplitude of said one or more transient DC voltages or said one or more transient DC voltage waveforms varies with time.

39. A mass spectrometer as claimed in claim 38, wherein the amplitude of said one or more transient DC voltages or said one or more transient DC voltage waveforms either: (i) increases with time; (ii) increases then decreases with time; (iii) decreases with time; or (iv) decreases then increases with time.

40. A mass spectrometer as claimed in claim 38, wherein said ion guide comprises an upstream entrance region, a downstream exit region and an intermediate regions wherein:

in said entrance region the amplitude of said one or more transient DC voltages or said one or more transient DC voltage waveforms has a first amplitude;

in said intermediate region the amplitude of said one or more transient DC voltages or said one or more transient DC voltage waveforms has a second amplitude; and in said exit region the amplitude of said one or more transient DC voltages or said one or more transient DC voltage waveforms has a third amplitude.

41. A mass spectrometer as claimed in claim 40, wherein the entrance and/or exit region comprise a proportion of the total axial length of said ion guide selected from the group consisting of: (i)< 5%; (ii) 5–10%; (iii) 10–15%; (iv) 15–20%; (v) 20–25%; (vi) 25–30%; (vii) 30–35%; (viii) 35–40%; and (ix) 40–45%.

42. A mass spectrometer as claimed in claim 40, wherein said first and/or third amplitudes are substantially zero and said second amplitude is substantially non-zero.

43. A mass spectrometer as claimed in claim 40, wherein said second amplitude is larger than said first amplitude and/or said second amplitude is larger than said third amplitude.

44. A mass spectrometer as claimed in claim 5, wherein one or more transient DC voltages or one or more transient DC voltage waveforms pass in use along said ion guide with a first velocity.

45. A mass spectrometer as claimed in claim 44, wherein said first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

46. A mass spectrometer as claimed in claim 44, wherein said one or more transient DC voltages or said one or more transient DC voltage waveforms causes ions within said ion guide to pass along said ion guide with a second velocity.

47. A mass spectrometer as claimed in claim 46, wherein the difference between said first velocity and said second velocity is less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

48. A mass spectrometer as claimed in claim 44, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

49. A mass spectrometer as claimed in claim 46, wherein said second velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

50. A mass spectrometer as claimed in claim 46, wherein said second velocity is substantially the same as said first velocity.

51. A mass spectrometer as claimed in claim 32, wherein said one or more transient DC voltages or said one or more transient DC voltage waveforms has a frequency, and wherein said frequency: (i) remains substantially constant; (ii) varies; (iii) increases; (iv) increases then decreases; (v) decreases; or (vi) decreases then increases.

52. A mass spectrometer as claimed in claim 32, wherein said one or more transient DC voltages or said one or more transient DC voltage waveforms has a wavelength, and wherein said wavelength: (i) remains substantially constant; (ii) varies; (iii) increases; (iv) increases then decreases; (v) decreases; or (vi) decreases then increases.

53. A mass spectrometer as claimed in claim 5, wherein two or more transient DC voltages or two or more transient DC voltage waveforms pass simultaneously along said ion guide.

54. A mass spectrometer as claimed in claim 53, wherein said two or more transient DC voltages or said two or more transient DC voltage waveforms are arranged to move: (i) in the same direction; (ii) in opposite directions; (iii) towards each other; or (iv) away from each other.

55. A mass spectrometer as claimed in claim 5, wherein one or more transient DC voltages or one or more transient DC voltage waveforms are repeatedly generated and passed in use along said ion guide, and wherein the frequency of generating said one or more transient DC voltages or said one or more transient DC voltage waveforms: (i) remains substantially constant; (ii) varies; (iii) increases; (iv) increases then decreases; (v) decreases; or (vi) decreases then increases.

56. A mass spectrometer as claimed in claim 5, further comprising an ion detector, said ion detector being arranged to be substantially phase locked in use with the pulses of ions emerging from the exit of the ion guide.

57. A mass spectrometer as claimed in claim 5, further comprising a Time of Flight mass analyser comprising an electrode for injecting ions into a drift region, said electrode being arranged to be energised in use in a substantially synchronised manner with the pulses of ions emerging from the exit of the ion guide.

58. A mass spectrometer as claimed in claim 5, further comprising an ion trap arranged downstream of said ion guide, said ion trap being arranged to store and/or release ions from said ion trap in a substantially synchronised manner with the pulses of ions emerging from the exit of the ion guide.

59. A mass spectrometer as claimed in claim 5, further comprising an mass filter arranged downstream of said ion guide, wherein a mass to charge ratio transmission window of said mass filter is varied in a substantially synchronised manner with the pulses of ions emerging from the exit of the ion guide.

60. A mass spectrometer as claimed in claim 5, wherein said ion guide is selected from the group consisting of: (i) an ion funnel comprising a plurality of electrodes having apertures therein through which ions are transmitted, wherein the diameter of said apertures becomes progressively smaller or larger; (ii) an ion tunnel comprising a plurality of electrodes having apertures therein through which ions are transmitted, wherein the diameter of said apertures remains substantially constant; and (iii) a stack of plate, ring or wire loop electrodes.

61. A mass spectrometer as claimed in claim 5, wherein each electrode has an aperture through which ions are transmitted in use.

62. A mass spectrometer as claimed in claim 5, wherein each electrode has a substantially circular aperture.

63. A mass spectrometer as claimed in claim 5, wherein each electrode has a single aperture through which ions are transmitted in use.

64. A mass spectrometer as claimed in claim 62, wherein the diameter of the apertures of at least 50%, 60%, 70%, 80%, 90% or 95% of the electrodes forming said ion guide is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

65. A mass spectrometer as claimed in claim 5, wherein at least 50%, 60%, 70%, 80%, 90% or 95% of the electrodes forming the ion guide have apertures which are substantially the same size or area.

66. A mass spectrometer as claimed in claim 5, wherein said ion guide comprises a segmented rod set.

67. A mass spectrometer as claimed in claim 5, wherein said ion guide is selected from the group consisting of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

68. A mass spectrometer as claimed in claim 5, wherein the thickness of at least 50%, 60%, 70%, 80%, 90% or 95% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

69. A mass spectrometer as claimed in claim 5, wherein said ion guide has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

70. A mass spectrometer as claimed in claim s, wherein at least 10%, 20%, 30%, 40%, 50%, 60%, 70%, 80%, 90%, or 95% of said electrodes are connected to both a DC and an AC or RF voltage supply.

71. A mass spectrometer as claimed in claim 5, wherein axially adjacent electrodes are supplied with AC or RF voltages having a phase difference of 180°.

72. A method of mass spectrometry comprising:

repeatedly generating or releasing packets of ions in a substantially pulsed manner;

receiving one or more packets of ions in an ion guide comprising a plurality of electrodes;

trapping said one or more packets of ions in one or more axial trapping regions within said ion guide;

translating said one or more axial trapping regions along at least a portion of the axial length of said ion guide; and releasing ions from said one or more axial trapping regions so that ions exit said ion guide in a substantially pulsed manner.

73. A method of mass spectrometry comprising:

generating or providing ions in a substantially continuous manner;

receiving said ions in an ion guide comprising a plurality of electrodes;

trapping said ions in one or more axial trapping regions within said ion guide;

translating said one or more axial trapping regions along at least a portion of the axial length of said ion guide; and releasing ions from said one or more axial trapping regions so that ions exit said ion guide in a substantially pulsed manner.

74. A method as claimed in claim 73, further comprising phase locking an ion detector to pulses of ions emerging from the exit of said ion guide.

75. A method as claimed in claim 73, further comprising synchronising the energisation of an electrode for injecting ions into a drift region of a Time of Flight mass analyser to pulses of ions emerging from the exit of said ion guide.

76. A method as claimed in claim 73, further comprising synchronising the storing and/or releasing of ions in an ion trap arranged downstream of said ion guide with the pulses of ions emerging from the exit of the ion guide.

77. A method as claimed in claim 73, further comprising synchronising varying the mass to charge ratio transmission window of a mass filter arranged downstream of said ion guide with the pulses of ions emerging from the exit of the ion guide.

78. A mass spectrometer as claimed in claim 1, further comprising an ion detector, said ion detector being arranged to be substantially phased locked in use with the pulses of ions emerging from the exit of the ion guide.

79. A method as claimed in claim 72, further comprising phase locking an ion detector to pulses of ions emerging from the exit of the said guide.

* * * * *